United States Patent [19]

Schweitzer

[11] 4,339,102

[45] Jul. 13, 1982

[54] READILY SEPARABLE JAR MOUNTING DEVICE

[76] Inventor: Earl O. Schweitzer, 29353 Luxona Rd., Wickliffe, Ohio 44092

[21] Appl. No.: 141,384

[22] Filed: Apr. 18, 1980

[51] Int. Cl.[3] ..... E04G 3/00

[52] U.S. Cl. ..... 248/221.1; 248/312; 211/88

[58] Field of Search ..... 248/221.1, 220.4, 312, 248/312.1; 211/88

[56] References Cited

U.S. PATENT DOCUMENTS

| | | | |
|---|---|---|---|
| 2,754,009 | 7/1956 | Kennedy | 248/312 X |
| 3,222,023 | 12/1965 | Schweitzer | 248/221.1 |
| 3,224,594 | 12/1965 | Schweitzer | 248/312 X |
| 3,565,384 | 2/1971 | Lockwood | 248/312 |

*Primary Examiner*—Wayne L. Shedd

*Attorney, Agent, or Firm*—Baldwin, Egan, Walling & Fetzer

[57] ABSTRACT

A mounting device for mounting a necked container such as a glass baby food jar, to a board support, such as a perforated board support; the device comprising a generally resilient C-shaped base for receiving and holding the neck of the container for suspending of the container from the device and means for coupling the device to the board support. The container is adapted to be assembled to the device by forcing the neck of the container through the open portion of the C-shaped base, whereby the arms of the base are forced outwardly during the insertion and/or removal of the container from the mounting device. The device which is preferably molded from plastic, enables rapid assembly and disassembly of the container to and from mounted condition on the board support.

14 Claims, 8 Drawing Figures

20
BH
BN
14
10
12
B
35
20b
20a
16
16a 37
21
24
20b
24a
14
30
BH
BN
16a
16
35
20a
32
10
12
32a
33
B 21
24
20a
24a
14
10
20
30
12
16a
16
32
34
32a
33

30
35
20b
20a
26
8
39
16
16a
38
32
34

24
14
20a
38
39
24a
26

21
24
14
20b
30
16a
24a
32
16
20
28
20a
36
34
32a
33

X'
24
16a
24a
16
14
B
38
36
39
26
28
X
BH
BN
20a
24
16a
X'
24a 21
24
35
20b
24a
20
30
28
6
6
16a
20a
16
32
34
33
32a

READILY SEPARABLE JAR MOUNTING DEVICE

This invention relates in general to mounting devices for mounting a necked container to a board support, and more particularly to a mounting device wherein the container can be rapidly coupled to the mounting device and just as rapidly disassembled from the mounting device with generally linear motion, and wherein the size and/or thread style of the neck of the container is not highly critical in enabling assembly and disassembly of the container to and from the mounting device.

BACKGROUND OF THE INVENTION

Mounting devices for mounting jars or necked containers, such as for instance baby food jars, onto a board support, such as a perforated board are well known in the art. One such arrangement is illustrated in U.S. Pat. No. 3,027,036, dated Mar. 27, 1962, in the name of Frances Budreck. Another such arrangement is applicant's own U.S. Pat. No. 3,222,023, dated Dec. 7, 1965 and illustrating a plastic cap-like member having threads on the interior thereof, for threadingly receiving the threaded neck of a jar or container to be assembled therewith, with the plastic mounting device having hook portions 20 and arm portions 26 adapted to be received through a respective perforation in the board support for mounting the device on the perforated board.

It is also known in the art to mount jars onto metal clamps which are suspended from an overhead beam or ceiling, and wherein the jar is snapped or forced into and out of suspended relation with the associated clamp with generally linear movement, and with such clamps having spaced shoulders formed from sheet material for clasping the neck of the jar to suspend the latter from the clamp. If such type clamps are not made to comparatively highly critical dimension relationship with respect to the jar neck size, the assembly of the container or jar to the clamp support is either quite difficult or impossible.

SUMMARY OF THE INVENTION

The present invention provides a mounting device formed preferably of generally resilient plastic and comprising a generally C-shaped base portion adapted to receive through the opening between the arms of the C, the neck of a container, by generally linear movement of the container relative to the base, whereby the arms of the C-shaped base are forced outwardly during the insertion and/or removal of the container from the mounting device, and with the device including means for coupling the base to a board support.

Accordingly, an object of the invention is to provide an inexpensive mounting device which can be readily mounted onto a board support and wherein a necked container can be rapidly snapped or pushed into assembled and suspended relation with respect to the mounting device, and can be just as rapidly disassembled from the mounting device.

A further object of the invention is to provide a mounting device of the aforementioned type wherein inexpensive and usually throw-away baby food jars of many different brands can be readily secured, for mounting on a board support.

Another object of the invention is to provide a mounting device of the aforediscussed type which may be formed of generally flexible plastic material lending itself to mass production of the device and wherein the device provides for rapid snapping into coaction therewith and snapping out of coaction therewith, of a necked container.

A still further object of the invention is to provide a mounting device of the above described type wherein the dimension of the neck of the container is not highly critical for permitting assembly and disassembly of the container to the mounting device.

A still further object of the invention is to provide a mounting device wherein necked jars having various types and dimensions of threaded configuration thereon can be utilized, irrespective of the type or style of threads on the neck of the jar, and wherein the neck of the jar is snapped into and out of coaction with the mounting device in a generally linear movement.

Other objects and advantages of the invention will be apparent from the following description taken in conjunction with the accompanying drawings wherein:

DESCRIPTION OF PREFERRED EMBODIMENT

Figure 1:
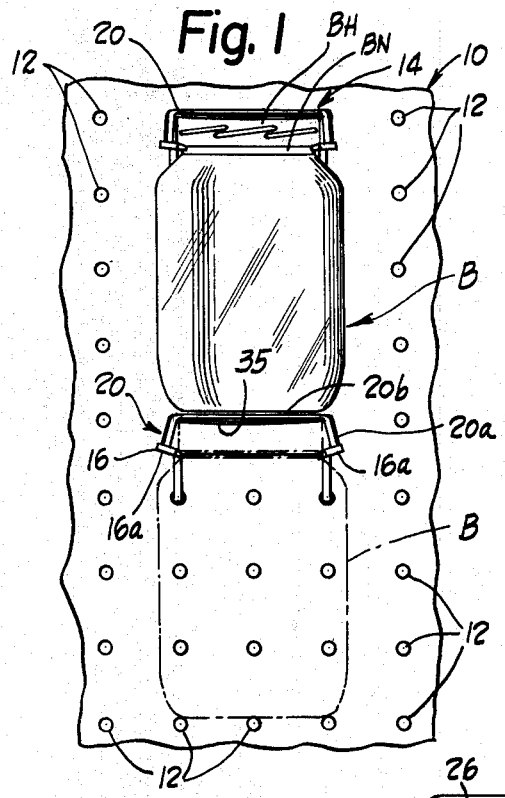
FIG. 1 is a reduced size, front elevational view of the mounting device of the invention as mounted on a perforated board support and with a threaded necked container being supported on the mounting device in depending relation therefrom. Below the full line container there is illustrated in phantom lines a container being inserted into, or removed from, an associated mounting device of the invention and illustrating the spreading of the C-shaped base portion during such insertion and/or removal of the container from the mounting device.

Referring again to the drawings, there is illustrated a support board 10, such as for instance conventional "pegboard" or the like, which has a plurality of holes 12 extending therethrough at generally regularly spaced intervals both horizontally and vertically.

The mounting device 14 of the invention comprises a generally resilient, C-shaped (in plan) base 16 adapted to receive and hold the neck BN of a container B, for mounting of the container on the board support. In the embodiment illustrated, the container has a threaded head BH which is conventionally provided with a threaded cap (not shown) for closing or sealing the container. There are many types of such containers utilized in the marketplace, and for instance baby food containers are a typical example. The various brands of baby food containers may have different styles of threads formed on the neck thereof, with the latest styles of such baby food containers being generally designed by varying the threads, so as to make it more difficult to replace a threaded cap on the container once it is removed or taken off, the purpose being to make it more difficult for shoppers to remove tops from containers and then to replace such top and put the jar back on the shelf of a store. However, while the mounting device has been illustrated as mounting a threaded container thereon, it will be understood that the threads on a container are not used in mounting the container onto the mounting device, and therefore whether or not the container or jar has threads in generally immaterial so far as concerns using it in conjunction with the mounting device of the invention.

As illustrated in the drawing, the base 16 is preferably oriented generally horizontally so that in plan it possesses a generally C-shaped configuration, with the opening between the arm portions 16*a* of the C facing outwardly for receiving the neck portion BN of the container B. The distance X (FIG. 6) between the distal ends of the shoulders 26 on arms 16*a* of the C base is less than the diameter of the neck portion BN of the container, so that the arms of the C-shaped base portion are spread or forced outwardly during the insertion into or removal of the container from the mounting device. The container is inserted into the mounting device by grasping the jar and generally linearly forcing the neck thereof between the arms 16*a*, whereby the arms move outwardly to receive the neck of the container within the base portion and to be suspended therefrom. Removal is accomplished by reversing the motion, to pull or snap the container outwardly from between the arms.

Figure 3:
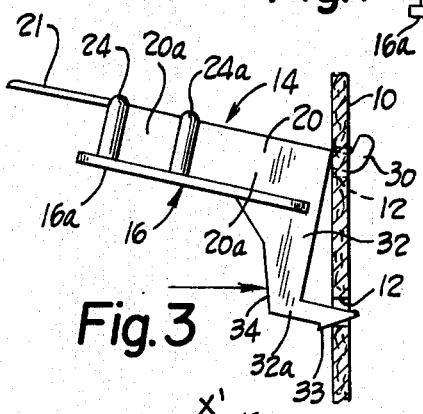
FIG. 3 is a side elevational view of the mounting device, showing the preferred method of assembly of the mounting device with a perforated board support.
Figure 5:
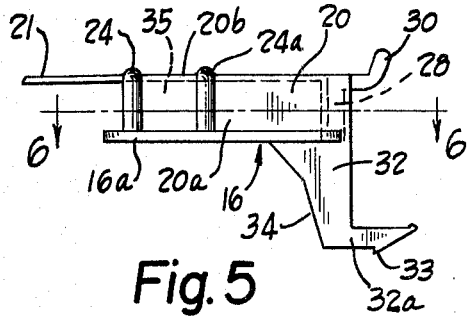
FIG. 5 is a side elevational view of the mounting device of the invention.

In the embodiment illustrated, the mounting device includes a head portion 20 extending generally upwardly from the base, with the head portion comprising a relatively thin (as compared to the thickness of the base) generally vertically oriented side wall section 20*a* and a top wall section 20*b* bridging the side wall and extending forwardly therefrom as at 21 (FIGS. 3 and 5). Rib means 24, 24*a* are provided extending from one of the arms 16*a* of the base upwardly along its respective side wall section 20*a* of the head and across the top wall 20*b* and then down along the opposite side wall section 20*a* of the head, to merge with the base 16 at the juncture of the sidewall 20*a* with the base. Rib 24 is disposed generally adjacent the forwardmost end of the side wall section 20*a* while rib 24*a* is disposed a generally predetermined amount therefrom so that the ribs 24, 24*a* are spaced substantially equal distances from the vertical center plane X'—X' of the side wall interior curvature.

Figure 6:
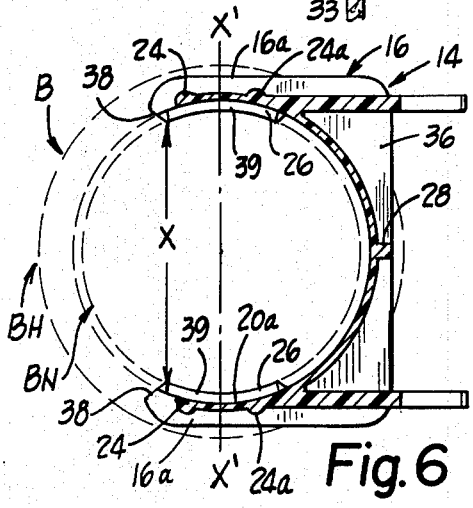
FIG. 6 is a horizontal sectional view taken generally along the plane of line 6—6 of FIG. 5 looking in the direction of the arrows, in phantom lines there is shown a necked container suspended from the mounting device.

Disposed adjacent the distal end of each of the arm sections 16*a* of the base is the aforementioned shoulder 26 of generally arcuate configuration (in plan) as best seen in FIG. 6, and which shoulder extends from the interior of the side wall 20*a*. Such shoulders receive the neck BN of the container therebetween and support the headed container on the mounting device in suspended relation.

Figure 2:
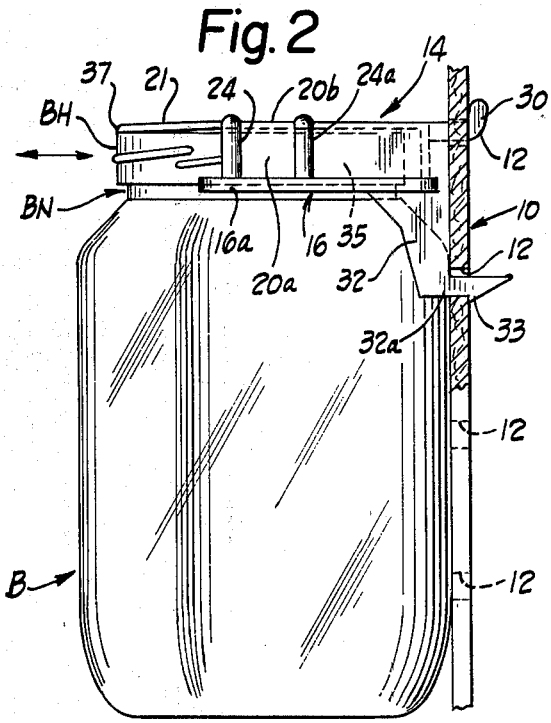
FIG. 2 is an enlarged, side elevational view of the mounting device of FIG. 1, with its associated container being supported thereby on a perforated wall support.
Figure 4:
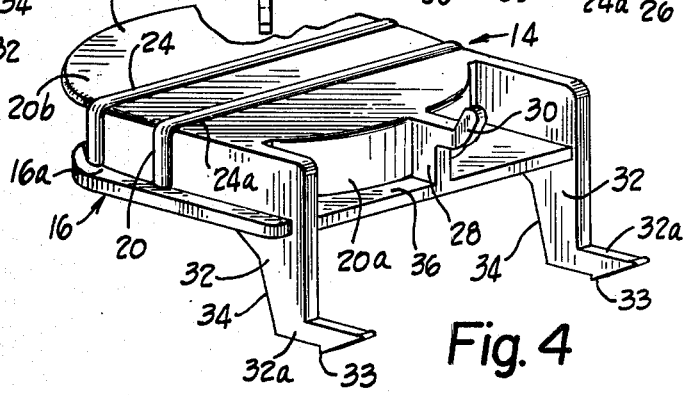
FIG. 4 is a partially broken, generally rear perspective view of the mounting device of FIGS. 1 through 3.

Projecting rearwardly from the rear exterior side of the side wall 20*a* is a web 28 (FIG. 4) having a hook 30 extending upwardly and rearwardly therefrom. Also extending rearwardly from the base past the side wall 20*a* are spaced arms 32 which extend downwardly and rearwardly from the base 16. Each of the legs 32 has a foot portion 32*a* which is adapted to be received through a respective opening or perforation in the board support 10, and with such foot portion having a hook or locking abutment 33 thereon which is adapted to snap behind the perforated board support as best seen in FIG. 2 upon assembly of the mounting device to the wall support. Hook 30 and legs 32 and associated feet 32*a* and abutment 33 provide coupling means for coupling the mounting device to the board support.

Referring now to FIG. 3, there is illustrated the preferred procedure for assembling the device to a board support by hooking the hook 30 on the mounting device through an associated perforation in the support 10, so that the legs 32 are directed toward their respective perforations in the board support, with the foot portions 32*a* extending partially through the respective opening, and then pressure (as shown by the full line arrow in FIG. 3) is applied to generally flat frontal surface 34 on the leg members 32, as by means of the fingers of the workman, to cause the foot portion to snap through its associated opening and into interlocking coaction between hook abutment 33 on the respective leg and the rear side of the board support, thus locking the mounting device 14 to the board support.

A container may then be rapidly assembled with the mounting device by moving the container generally linearly in the direction of the right hand arrow head illustrated in FIG. 2, to force the neck of the container past the open dimension X of the C-shaped base, to cause spreading of the arms 16*a* of the C base as illustrated in FIG. 1 of the drawings by the lower phantom defined container, whereby the neck of the jar or container is forced into the chamber 35 defined by the base and the head portion of the mounting device, whereupon the resiliency of the arms return the arms to generally their original position, for grasping the holding the container in suspended relation on the mounting device.

It will be seen that the web 28 and associated hook 30 strengthens the rearward section 36 of the C, which is maintained with a generally minimum dimensions so as to not only conserve the material from which the mounting device is made, but also to cause mounting of the container or jar B as close as possible without interference to the board support 10 thus making a more stable mounting of the container on the board support 10.

The ribs 24, 24*a* also strengthen the arms, as well as strengthening the head portion of the mounting device, and help to insure that the arms will return to their original position after the neck of the bottle is forced between the arms into assembled relationship with the mounting device. It will be noted as can be best seen in FIGS. 2 and 5 that the top wall 20*b* which projects as at 21 outwardly beyond the side wall 20*a* of the head portion of the mounting device, slopes slightly diagonally downwardly so that such forward portion of the top wall generally engages the top of the container at 37, (FIG. 2) thus helping to urge the container down into engagement with the shoulders 26 as well as providing a complete cover for the container. Such downwardly sloped configuration of portion 21 of the top wall is accomplished (when the mounting device is formed of plastic) due to the fact that the plastic top wall section 20*b* being thinner than the associated frontal rib 24 from which it extends forwardly, is moved slightly downwardly during solidification of the hot plastic as it cools, thus automatically providing the desired downward slope of the section 21 of the top wall. Moreover such top wall section 21 provides a better looking, close fitting appearance, as well as urging the container into engagement with the lips or shoulders 26.

Figure 7:
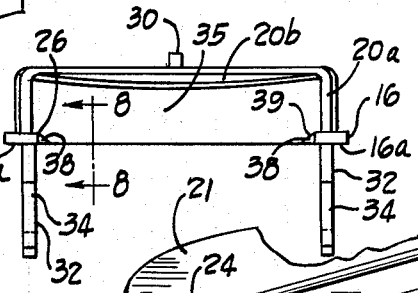
FIG. 7 is an enlarged front elevational view of the mounting device of FIGS. 1 through 6.
Figure 8:
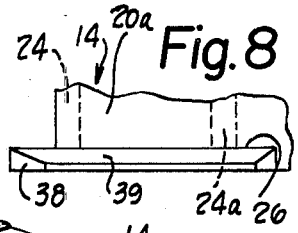
FIG. 8 is an enlarged, fragmentary view taken generally along the plane of line 8—8 of FIG. 7, looking in the direction of the arrows, and showing in particular one of the shoulders which suspends or supports the container on the mounting device.

As can be best seen in FIGS. 6 and 7, the distal ends of the arms 16*a* and adjacent shoulders 26 of the mounting device preferable have outwardly divergent camming surfaces 38 thereon for aiding in guided movement of the neck BN of the container past the arm portions during linear insertion of the container into assembled relationship with the mounting device. Also the shoulder portions 26 generally slope downwardly on their upper surfaces as at 39 (FIGS. 6 and 8) for providing some leeway between the top or upper end of the container head BH and the underside of the top closure wall 20*b*, to accommodate various sizes and types of containers so that such vertical head dimension and neck dimension of the container are not highly critical in being able to mount a container to the mounting device.

As can be seen the reinforcing ribs 24, 24*a* coact with the shoulder or lip portions 26 and with the side wall 20*a* of the mounting device in the vicinity of the shoulder or lip portions, so as to help to insure that the side walls return or urge the lip or shoulder portions 26 to their original positions when the container is either inserted into or removed from the mounting device.

The mounting device is preferably formed of some flexible or generally resilient plastic material having memory, such as for instance polyethylene, which not only provides the resiliency to the generally C-shaped base portion to enable the snapping of the container into and out of coacting relationship with the mounting device, but also lends itself to injection molding mass production procedures, for convenient manufacture of the device.

From the foregoing discussion and accompanying drawings, it will be seen that the invention provides a novel mounting device for mounting a necked container to a board support and wherein such device comprises a generally resilient, substantially C-shaped base adapted to receive the neck of a container therein in snap fastened relation, for suspending the container from the support, and including means for coupling the base to a board support. The invention also provides a mounting device which can be economically manufactured utilizing mass production procedures, and wherein the container can be rapidly mounted or assembled to the device and rapidly removed from the device, for use of the contents of the container, and wherein the dimensions or style of the neck portion of the container are not highly critical as to whether or not the container will be assembleable with the mounting device.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. A one piece mounting device formed of plastic for mounting a necked container to a generally vertically oriented board support comprising a generally resilient, C-shaped, in plan, base, adapted to receive and hold the neck of a container for assembly of the container to the mounting device, upon generally linear movement of the container in the direction of the open portion of the C, and permitting disassembly of the container from the device upon reverse generally linear movement of the container, and means projecting laterally outwardly of said base for coupling said base to a board support, and wherein said base is adapted for generally horizontal orientation on a board support, with the open portion of the C facing outwardly for receiving the neck portion of the container, the distance between the distal ends of the arms of the C being less than the transverse distance across the neck of the associated container, whereby the arms of the C-shaped base are forced outwardly during the insertion and/or removal of the container from the mounting device, the closed portion of the C being of predetermined generally minimum width dimension and adapted to provide for mounting of the container close to but without interference with the board support.

2. A device in accordance with claim 1 wherein said means comprises projection means adapted to be received through an associated perforated board support for coupling said mounting device to the board support.

3. A device in accordance with claim 1 which includes a head portion secured to and extending upwardly from said base, said head portion including a relatively thin generally vertically oriented side wall section and a top wall section bridging said side wall section and extending forwardly therefrom, said side and top wall sections defining in conjunction with said base a chamber adapted for receiving therein the neck of the container for suspending the container from said device, said coupling means projecting rearwardly relative to said side wall section.

4. A device in accordance with claim 3 including ribs reinforcing said side wall section and extending across said top wall section, one of said ribs being located at the forward extremity of said side wall section commencing at the juncture between said side wall section and said base, and extending transverse of said top wall section.

5. A device in accordance with claim 1 wherein said coupling means includes a generally upwardly projecting hook adapted for being received through a perforation in the board support, and leg means spaced from said hook and likewise adapted to be received through another perforation in the board support.

6. A device in accordance with claim 1 including a generally vertically extending wall projecting upwardly from said C-shaped base and following the general contour thereof, and a top cover wall connecting said side wall to define in conjunction with said base a chamber adapted for receiving therein the neck of a container for suspending the latter from said device.

7. A device in accordance with claim 3 including reinforcing ribs extending from one side of said C-shaped base to the other side thereof on the exterior of said head portion, said ribs reinforcing said head portion and merging with said base at the juncture between said side wall section and said base, one of said ribs being located at the forward extremity of said side wall section commencing at the last mentioned juncture and extending up said side wall section and transverse of said top wall section, another of said ribs being spaced rearwardly of said one rib and extending in generally parallel relation therewith.

8. A device in accordance with claim 6 wherein said top wall projects forwardly of the confines of said generally vertically extending wall, and slopes downwardly commencing at the forward extremity of the vertically extending wall, to the distal end of said top wall, said downwardly sloped portion of said top wall at said distal end thereof being adapted to engage the top edge of a container, for urging the container down into engagement with said base.

9. A device in accordance with claim 1 wherein said C-shaped base at its open side has outwardly divergent abutment surfaces adapted for engaging the neck of the container preparatory to the arms of the C-shaped base being forced outwardly to permit entry of the neck portion of the container therein.

10. A device in accordance with claim 6 including shoulder portions adjacent the distal ends of the arms of the C-shaped base, on the interior thereof, for supporting the neck of the container irrespective of variances in sizes of the neck of the container, said shoulder portions in plan being of generally arcuate configuration, each of said shoulder portions being disposed generally equally on opposite sides of the transverse vertical centerplane of the interior surface of said side wall, the top surface of each shoulder portion sloping downwardly in the general direction of the center of curvature of said interior surface of said side wall.

11. A device in accordance with claim 6 wherein said generally vertically extending wall is of a substantially thinner dimension as compared to the thickness dimension of said C-shaped base.

12. A mounting device for mounting a necked container to a board support comprising, a generally resilient, C-shaped base adapted to receive and hold the neck of a container for assembly of the container to the mounting device, and permitting disassembly of the container from the device, and means for coupling said base to a board support, said base being adapted for generally horizontal orientation on a board support, with the open portion of the C facing outwardly for receiving the neck portion of a container, with the distance between the distal ends of the arms of the C being less than the transverse distance across the neck of the associated container, whereby the arms of the C-shaped base are forced outwardly during the insertion and/or removal of the container from the mounting device, and including a generally vertically extending wall projecting upwardly from said C-shaped base and following the general contour thereof, a top cover wall connecting said side wall to define in conjunction with said base a chamber adapted for receiving therein the neck of the container for suspending the latter from said device, said generally vertically extending wall being of a substantially thinner dimension as compared to the thickness dimension of said base, and wherein said top wall projects forwardly of the confines of said generally vertically extending wall, and slopes downwardly from a generally horizontal plane commencing at the forward extremity of said vertical wall, and extending to the distal end of said top wall, rib means reinforcing said vertically extending wall and extending across said top wall, said rib means being disposed at the forward extremity of said vertically extending wall at the juncture between the latter and said base, said coupling means comprising a hook projecting rearwardly with respect to said base, and spaced legs projecting downwardly and rearwardly from said base, said hook and said legs being adapted to be received through perforations in a board support, and means on said legs for locking the latter to the support, said device being formed of plastic.

13. In combination, an apertured board support and a one piece mounting device formed of plastic for mounting a necked container to the support, said device comprising a generally resilient, C-shaped, in plan, gripping means for releasably receiving and holding the neck portion of the container whereby the container can be moved generally linearly selectively toward and away from the support and into and out of coacting relation with said gripping means, for respectively mounting the container on the support and removing the container from the support, and means on said device projecting laterally outwardly of said gripping means and extending through perforations in said support and coupling said device to said support, said gripping means being generally horizontally oriented on said support, with the open portion of its C-shaped configuration facing outwardly for receiving the neck portion of the container, the distance between the distal ends of the arms of the C being less than the transverse distance across the neck of the associated container, whereby the arms of the C are forced outwardly during the insertion and/or removal of the container from the mounting device, the closed portion of the C being of predetermined generally minimum width dimension for providing for mounting of the container close to but without interference with said support.

14. The combination in accordance with claim 13 including a generally vertically extending side wall projecting upwardly from said C-shaped gripping means and following the general contour thereof, and a top cover wall connecting said side wall to define in conjunction with said gripping means a chamber adapted for receiving therein the neck of a container for suspending the container from said device, said top wall projecting forwardly of the confines of said side wall and sloping downwardly commencing at the forward extremity of said side wall, the downwardly sloped portion of said top wall at its forwardmost edge being adapted to engage the top edge of a container, said arms of said gripping means including shoulder portions generally adjacent the distal ends thereof on the interior thereof and projecting generally laterally inwardly for supporting the neck of the container, the top surface of each shoulder portion sloping downwardly in the general direction of the center of curvature of said gripping means and adapted to support the neck of an associated container in a manner to provide for variances in size of containers.

* * * * *